US010688817B2

(12) United States Patent
Jorba Closa et al.

(10) Patent No.: US 10,688,817 B2
(45) Date of Patent: Jun. 23, 2020

(54) PRINTER CONFIGURATION

(71) Applicant: Hewlett-Packard Development Company, L.P., Houston, TX (US)

(72) Inventors: Joan Albert Jorba Closa, Sant Cugat del Valles (ES); Lluis Hierro Domenech, Sant Llorenc d'Hortons (ES); Mauricio Seras Franzoso, Sant Cugat del Valles (ES)

(73) Assignee: Hewlett-Packard Development Company, L.P., Spring, TX (US)

( * ) Notice: Subject to any disclaimer, the term of this patent is extended or adjusted under 35 U.S.C. 154(b) by 22 days.

(21) Appl. No.: 15/569,950

(22) PCT Filed: Jul. 9, 2015

(86) PCT No.: PCT/US2015/039685

§ 371 (c)(1),
(2) Date: Oct. 27, 2017

(87) PCT Pub. No.: WO2017/007481

PCT Pub. Date: Jan. 12, 2017

(65) Prior Publication Data

US 2018/0154663 A1 Jun. 7, 2018

(51) Int. Cl.
*B41J 19/14* (2006.01)
*B41J 2/21* (2006.01)
(Continued)

(52) U.S. Cl.
CPC ..... *B41J 19/145* (2013.01); *B41J 2/2135* (2013.01); *B41J 19/14* (2013.01); *B41J 2/01* (2013.01); *B41J 2029/3935* (2013.01)

(58) Field of Classification Search
CPC ..... B41J 19/145; B41J 2/2135; B41J 29/393; B41J 2029/3935
See application file for complete search history.

(56) References Cited

U.S. PATENT DOCUMENTS 6,431,775 B1 8/2002 Huang et al.
6,760,056 B2 7/2004 Klassen et al.
(Continued)

FOREIGN PATENT DOCUMENTS

CN 101204888 6/2008
CN 104417056 3/2015
(Continued)

OTHER PUBLICATIONS

Kamasak, M. et al., "Dynamic Print Mode Control for inkjet Printing", Oct. 26, 2001, 5 pages.

*Primary Examiner* — Kristal Feggins
*Assistant Examiner* — Kendrick X Liu
(74) *Attorney, Agent, or Firm* — HP Inc. Patent Department

(57) ABSTRACT

Examples associated with printer configuration are disclosed. One example includes printing, using a printer, a first portion of a test patch in a first print direction. A second portion of the test patch is printed in a second print direction. The second portion is printed at a first offset from the first portion. A first portion of a second test patch is printed in the first print direction, and a second portion of the second test patch is printed in the second print direction at a second offset from the first portion of the second test patch. The printer is configured to print in the second print direction using one of the first offset and the second offset based on a selection between the first test patch and the second test patch.

17 Claims, 7 Drawing Sheets

(51) Int. Cl.
*B41J 29/393* (2006.01)
*B41J 2/01* (2006.01)

(56) References Cited

U.S. PATENT DOCUMENTS

| | | | | |
|---|---|---|---|---|
| 7,390,073 | B2 | 6/2008 | Bailey et al. | |
| 8,235,516 | B2 | 8/2012 | Auslander et al. | |
| 8,251,477 | B2 | 8/2012 | Borrell et al. | |
| 8,336,982 | B2 | 12/2012 | Vall et al. | |
| 2002/0158936 | A1* | 10/2002 | Otsuka | B41J 2/2135 347/19 |
| 2004/0080555 | A1 | 4/2004 | Otsuki et al. | |
| 2004/0207674 | A1 | 10/2004 | Otsuki | |
| 2006/0066658 | A1 | 3/2006 | Olson | |
| 2007/0146742 | A1 | 6/2007 | Klassen | |
| 2009/0027440 | A1 | 1/2009 | Sayama | |
| 2009/0092408 | A1 | 4/2009 | Mizes et al. | |
| 2012/0001972 | A1 | 1/2012 | Nishioka et al. | |
| 2013/0163010 | A1* | 6/2013 | Yoshida | B41J 19/142 358/1.8 |
| 2015/0009262 | A1 | 1/2015 | Bell et al. | |
| 2015/0024166 | A1 | 1/2015 | Bilodeau | |

FOREIGN PATENT DOCUMENTS

| | | |
|---|---|---|
| EP | 0895869 | 2/1999 |
| EP | 0947323 | 10/1999 |
| EP | 1078771 | 2/2001 |

* cited by examiner

PRINTER CONFIGURATION

BACKGROUND

Printers are used to convert electronic documents (e.g., prepared on a computer) to hard copies. Some printers operate by ejecting ink onto a print medium from printheads along a path and feeding the print medium (e.g., paper) through the printer so that the next portion of a document can be printed. To conserve movement of the printheads, some printers can print in both directions along this path. Depending on the type of job being printed, portions of a print job may be printed in single passes of printheads over a given area, or in multiple passes over the given area. For jobs involving area fills, as opposed to, for example, print jobs primarily involving text, multiple passes over the same area may increase image quality.

BRIEF DESCRIPTION OF THE DRAWINGS

The present application may be more fully appreciated in connection with the following detailed description taken in conjunction with the accompanying drawings, in which like reference characters refer to like parts throughout, and in which.

DETAILED DESCRIPTION

Systems, methods, and equivalents associated with printer configuration are described. As mentioned above, when printing area fills, some printers may complete multiple passes over the same area to increase image quality. This is because a single pass may miss patches of the area. Consequently, image quality of an area fill may be increased by covering the area fill with multiple passes of ink in different directions because ink ejected in a first direction may cover a different portion of the print media than ink ejected in a second direction. However, despite efforts to print in a uniform manner, some small patches of print media may still be missed and some patches may receive multiple layers of ink due to, for example, misalignment of the two print directions. This may result an image defect known as graininess which makes images appear to have a granular appearance due to a clumping of ink into some areas, while missing others.

Consequently it may be desirable to attempt to limit graininess when configuring a printer to ensure high image quality of area fills in subsequent print jobs. This may be achieved by printing several test patches. The test patches may be formed by printing a first portion of each test patch in a first direction, and printing second portions of each test patch in a second direction. The second portions of each test patch may be printed at different offsets from respective first portions of each test patch. This may create several test patches having slightly differing image quality based on how much overlap there is between printed portions of the test patches. A selection between these test patches may be made by, for example, a user, and a configuration file may be updated with an offset that corresponds to that test patch. Subsequent print jobs executed by the printer involving area fills may be completed using the stored offset value for passes over the print media in the second direction to maintain the desired image quality.

Some other techniques for aligning printers may have included providing lines and/or crosses to an image quality evaluator (e.g. a user, a module via a scanner). These techniques may be useful for aligning printers primarily used for printing, for example, schematics, text, computer aided design (CAD) drawings, and so forth, where the focus of content may not be on filled in areas of printed content. However, these line and cross techniques may not adequately align printheads for area fills which may be important for the image quality of, for example, graphics.

Figure 1:
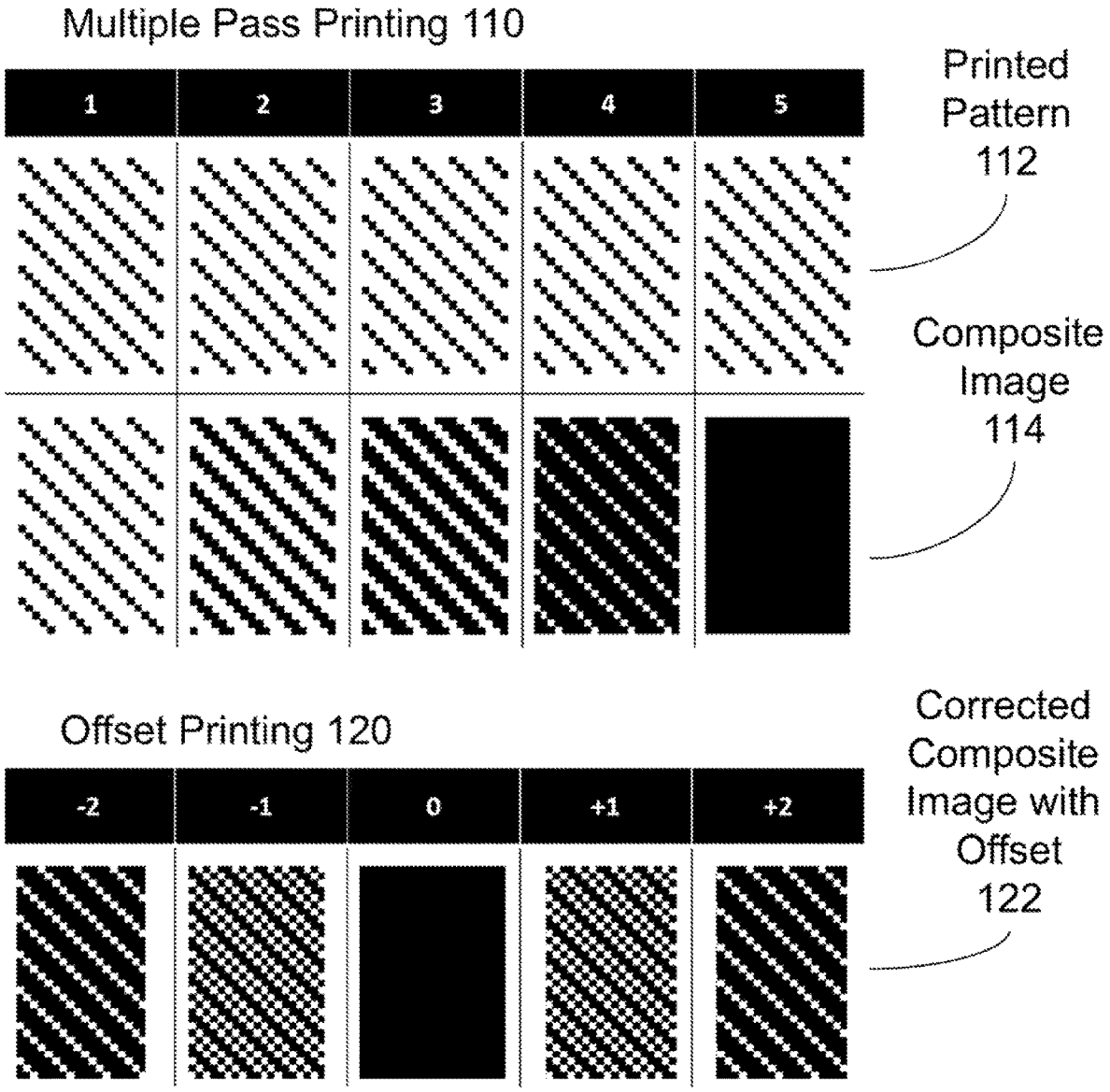
FIG. 1 illustrates example print patterns associated with printing area fills.

FIG. 1 illustrates example print patterns associated with printing area fills. It should be appreciated that the patterns depicted in FIG. 1 are illustrative examples and many different print patterns may be possible depending on how printers are configured.

FIG. 1 illustrates example print patterns associated with printing area fills. For example, FIG. 1 includes print patterns associated with multiple pass printing 110. Specifically, the print patterns associated with multiple pass printing 110 show a pattern 112 of ink printed in each of 5 passes over an area, and a composite image 114 of the area after that pass. Consequently, after 5 passes, the entire area has been covered in that composite image 114. In this example, each individual square in a printed pattern 112 may be one unit of ink that is printed as a printer passes over a print medium. In various examples, a printer may perform the odd numbered passes in a first direction, and the even numbered passes in a second direction.

FIG. 1 also includes examples of offset printing patterns 120. Specifically, corrected composite images 122 based on varying offsets are shown. These images may be results of completing 5 passes shown above associated with printed pattern 112, where the even passes are performed in the second direction at various offsets ranging from −2 units to +2 units. In this example, the 0 offset is illustrated as generating a uniform area fill. However, in other examples, due to a defect in a print cartridge, degradation of a print cartridge over time, and so forth, a different offset may be used to generate uniform area fills. Consequently, a user may be presented with the composite images 122 and make a selection based on which one the user believes has a desired image quality. An offset associated with user's selection may be stored in the printer that generates the composite images 122, and the printer may print portions of area fills in the second direction using that offset. In some examples, a module (e.g., in the printer) may replace the user when the printer has a way to, for example, scan the composite images 122 and provide the scanned images to the module.

It is appreciated that, in the following description, numerous specific details are set forth to provide a thorough understanding of the examples. However, it is appreciated that the examples may be practiced without limitation to these specific details. In other instances, methods and structures may not be described in detail to avoid unnecessarily obscuring the description of the examples. Also, the examples may be used in combination with each other.

"Module", as used herein, includes but is not limited to hardware, firmware, software stored on a computer-readable medium or in execution on a machine, and/or combinations of each to perform a function(s) or an action(s), and/or to cause a function or action from another module, method, and/or system. A module may include a software controlled microprocessor, a discrete module, an analog circuit, a digital circuit, a programmed module device, a memory device containing instructions, and so on. Modules may include gates, combinations of gates, or other circuit components. Where multiple logical modules are described, it may be possible to incorporate the multiple logical modules into one physical module. Similarly, where a single logical module is described, it may be possible to distribute that single logical module between multiple physical modules.

Figure 2:
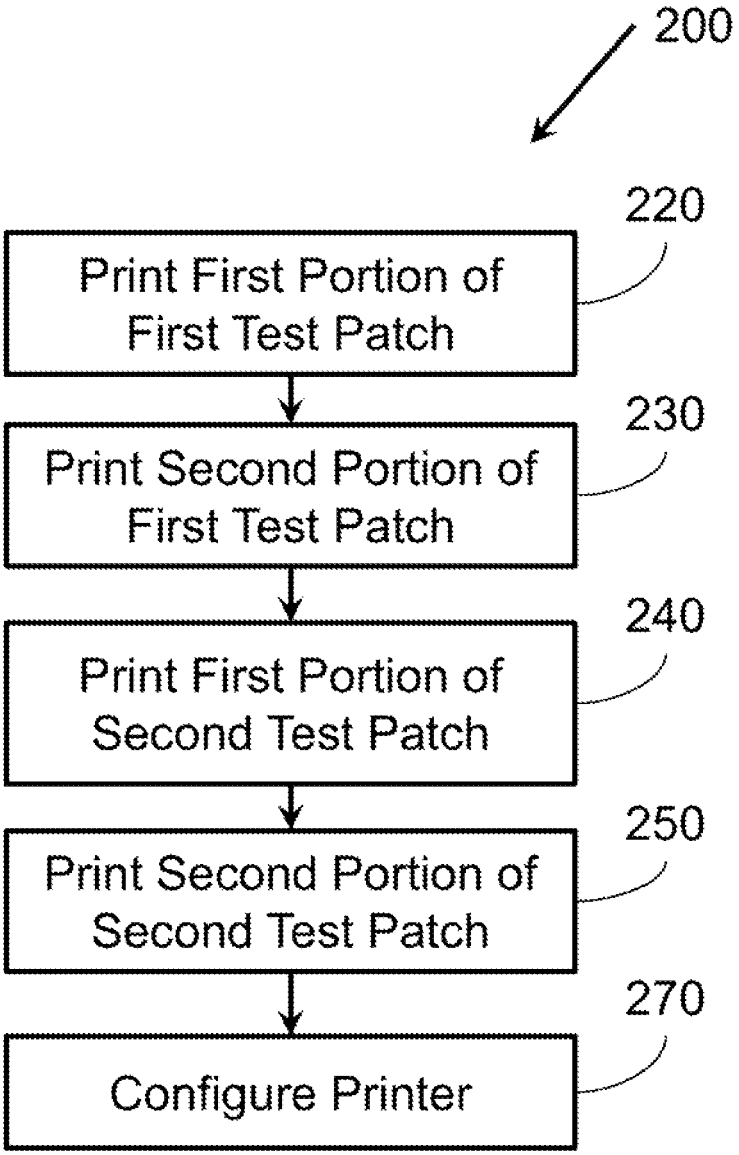
FIG. 2 illustrates a flowchart of example operations associated with printer configuration.

FIG. 2 illustrates an example method 200 associated with printer configuration. Method 200 may be embodied on a non-transitory computer-readable medium storing processor-executable instructions. The instructions, when executed by a processor, may cause the processor to perform method 200. In other examples, method 600 may exist within logic gates and/or RAM of an application specific integrated circuit (ASIC).

Method 200 includes printing a first portion of a first test patch at 220. The first portion of the test patch may be printed in a first print direction. The first portion of the first test patch may be printed by a printer.

Method 200 also includes printing a second portion of the first test patch at 230. The second portion of the first test patch may be printed in a second print direction by the printer. The second portion of the first test patch may be printed at a first offset from the first portion of the first test patch. In some examples, the first offset may be a zero offset, or no offset.

Method 200 also includes printing a first portion of a second test patch at 240. The first portion of the second test patch may be printed in the first print direction by the printer.

Method 200 also includes printing a second portion of the second test patch at 250. The second portion of the second test patch may be printed in the second print direction. The second portion of the second test patch may be printed at a second offset from the first portion of the second test patch.

Printing the first portion of the first test patch together with printing the second portion of the first test patch may result in the first test patch having a first graininess. Similarly, printing the first portion of the second test patch and printing the second portion of the second test patch may result in the second test patch having a second graininess. The different levels of graininess may be a result of ink being ejected onto a print medium (e.g., paper) in differing patterns. Greater coverage of ink over the test patch may be considered less grainy, and which may be desirable because lower graininess may result in enhanced image quality of area fills on subsequent print jobs. These different levels of graininess may be evaluated by a visual or optical inspection of the test patches. Consequently, selecting between the first test patch and the second test patch may be performed based on the first graininess and the second graininess.

Once a selection has been made regarding a desired test patch based on graininess, this selection may be remembered by the printer by storing information regarding an offset of a test patch that is selected. To retain information regarding a desired offset, method 200 includes configuring the printer at 270. The printer may be configured to print in the second print direction using one of the first offset and the second offset. Which offset is selected may be based on a selection made between the first test patch and the second test patch. In various examples, configuring the printer may include updating an alignment file that the printer reads when completing print jobs. The alignment file may be stored, for example, in a memory of the printer, a memory of a printhead, a memory of an attached device (e.g., a computer that controls the printer), and so forth.

It should be appreciated that some of the steps of method 200, and other methods described herein, may be performed in alternative orders that are not explicitly discussed. By way of illustration, for by some printers, it may be efficient to print both the first portion of the first test patch at 220, and the first portion of the second test patch at 240 before printing the second portion of the first test patch at 230, and the second portion of the second test patch at 250. In another example, when the second print direction is directly opposite the first print direction, when printing second portions of test patches, printheads of the printer may be traveling in a direction opposite of a direction traveled when printing first portions of test patches. Consequently, it may be efficient to print the second portion of the second test patch 250 before printing second portions of the first test patches at 230. Further, there may be cases where test patches require multiple passes by the printer due to, for example, a size of the test patches, the portions being subdivided into multiple passes, and so forth. In this example, printing of first portions and second portions of test patches may be interwoven to efficiently generate the test patches.

Figure 3:
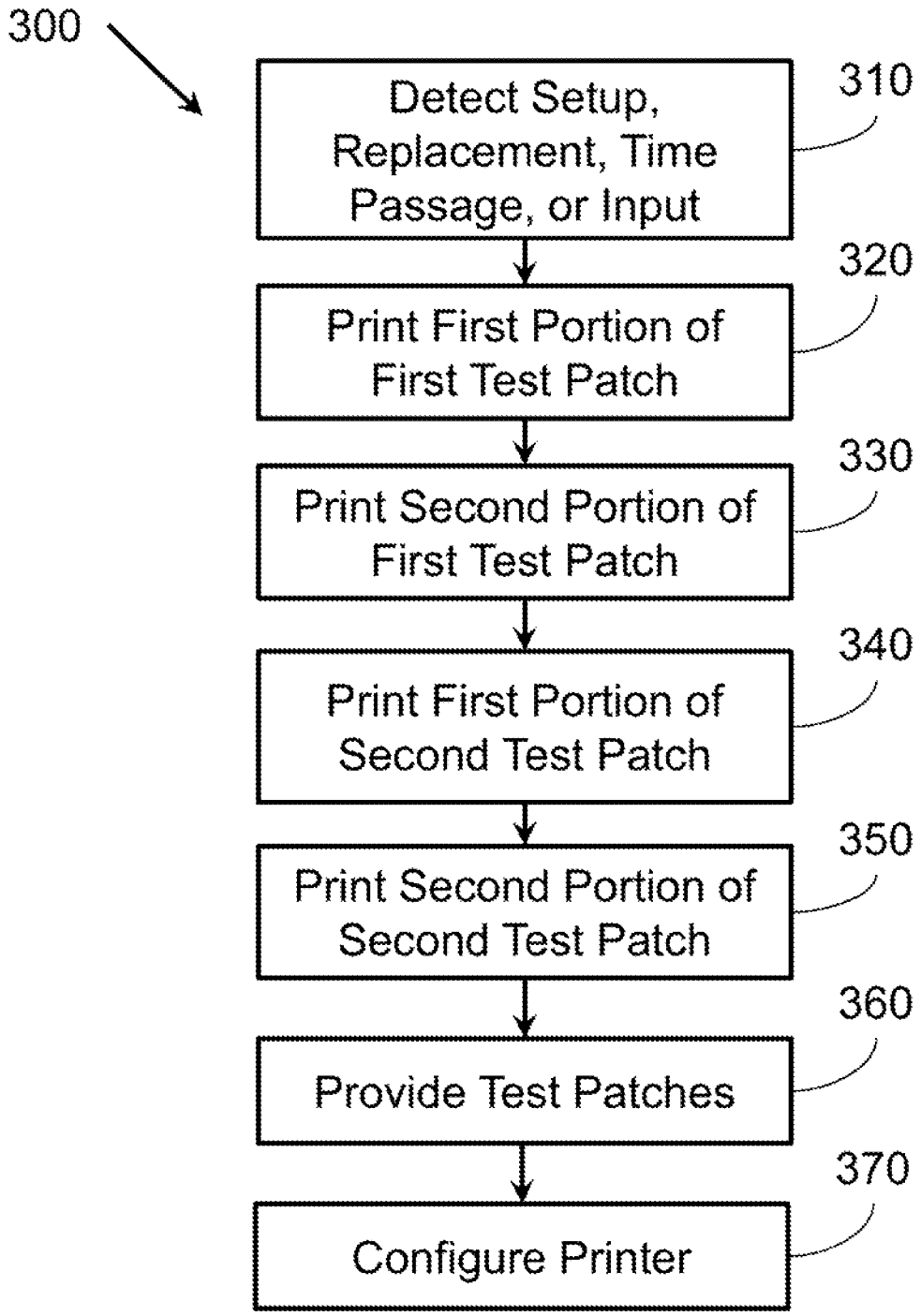
FIG. 3 illustrates another flowchart of example operations associated with printer configuration.

FIG. 3 illustrates a method 300 associated with printer configuration. Method 300 includes several actions similar to those described above with reference to method 200 (FIG. 2). For example, method 300 includes printing, by a printer, a first portion of a first test patch at 320, printing a second portion of the first test patch at 330, printing a first portion of a second test patch at 340, printing a second portion of the second test patch at 350, and configuring the printer at 370.

Method 300 also includes detecting an initial setup of the printer, a replacement of a component of the printer, passage of a predetermined period of time, and an input at 310. These triggering scenarios may be events the printer is designed to consider important enough to warrant performing or re-performing area fill calibration of the printer. Initial setup of the printer may be a desirable time to configure area fill graininess because different printers, despite coming from the same factory, may have minor differences in manufacture that affect graininess, and therefore adjusting the offset prior to the first use of the printer may be desirable. Similarly, replacement of a printer component (e.g., a printhead), may be a desirable time to adjust graininess offsets to ensure high print quality. Further, as printers are used, print quality may degrade over time (e.g., due to ink drying on printhead nozzles) resulting in a change in the pattern of ink ejected onto print media. Therefore, periodic reconfiguration may be desirable after a certain amount of time has passed. Finally, it may be desirable to allow an input from a user to trigger a readjustment of the stored offset if the user feels the image quality of area fills is lower than desirable. Though four example scenarios where the printer performs offset alignment are described, there may be additional scenarios where it is desirable to perform or re-perform this alignment.

Method 300 also includes providing the first test patch and the second test patch at 360. The first test patch and the second test patch may be provided to the user. In this example, the selection between the first test patch and the second test patch may be received from the user. In other examples, where the printer has an attached optical input device (e.g., a camera, a scanner), a module in the printer may be designed to select a test patch by analyzing image quality of the first test patch and the second test patch.

Figure 4:
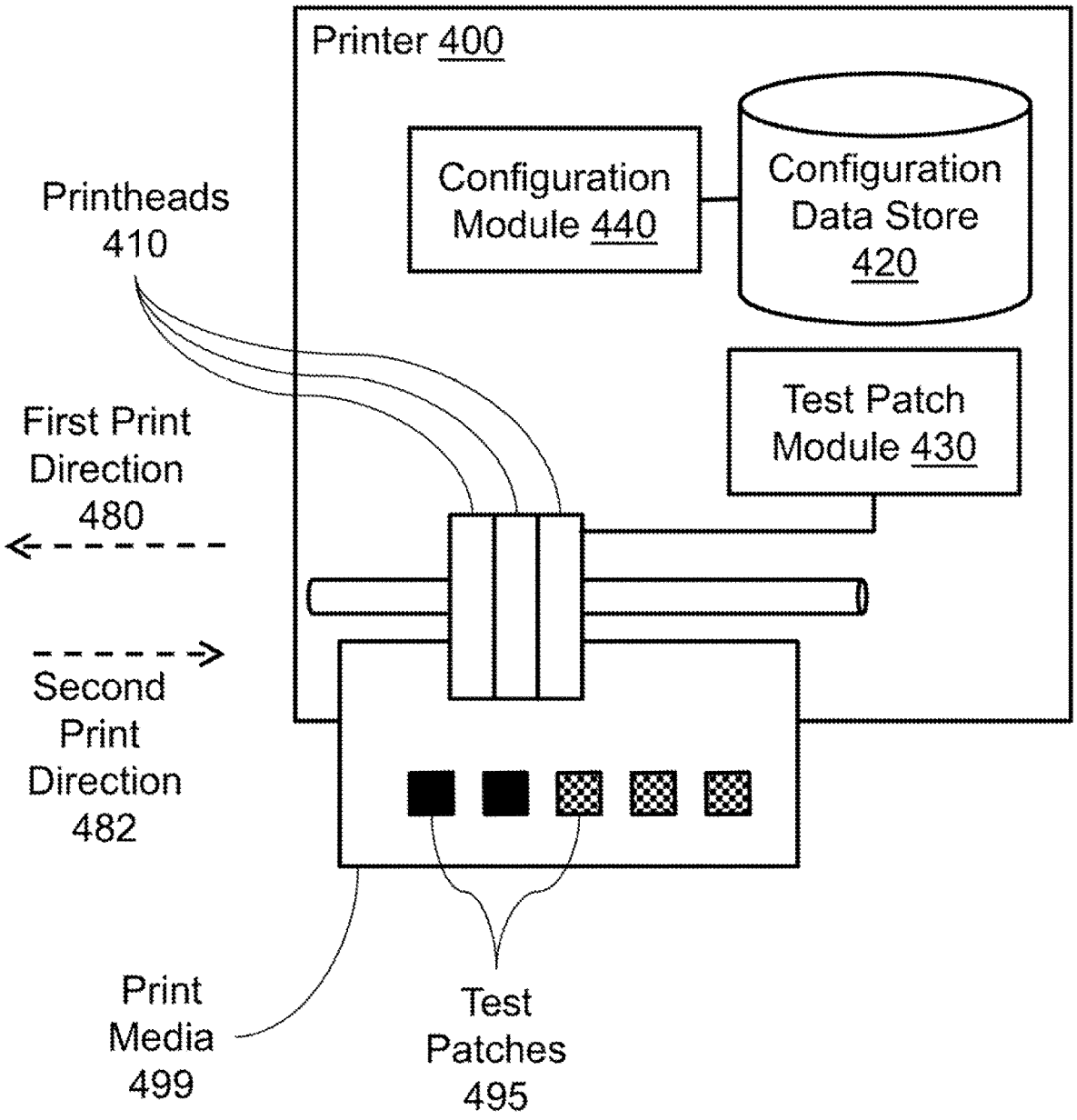
FIG. 4 illustrates an example printer associated with printer configuration.

FIG. 4 illustrates an example printer 400 associated with printer configuration. Printer 400 includes a set of printheads 410. The printheads may be arranged to print in a first print direction 480 and in a second print direction 482. Second print direction 482 may be opposite first print direction 480. In this example, printheads 410 are illustrated as being attached to a stability rail (not numbered) which is parallel to first print direction 480 and second print direction 482. Printheads 410 may be moved along the rail by, for example, a motor (not illustrated) attached to the printheads 410 via a band (not illustrated) that also runs parallel to first print direction 480 and second print direction 482. Other mechanisms for moving the print heads within printer 400 may also be appropriate.

Printer 400 also includes a configuration data store 420. Configuration data store 420 may store alignment information for set of printheads 410. Here, the alignment information may include a bidirectional offset value. The bidirectional offset value may be used by printer 400 when printing area fills of documents to facilitate printing area fills in a uniform manner.

Printer 400 also includes a test patch module 430. Test patch module 430 may control set of printheads 410 to print first portions of a set of test patches 495 in first print direction 480. Test patch module 430 may also control set of printheads 410 to print second portions of the set of test patches 495 in second print direction 482. The second portions of test patches 495 may be printed at a variety of offsets from the first portions. In this example, printer 400 is illustrated as being in the process of printing second portions of test patches 495 onto a print media 499. Print media 499 may be for example, paper, photo paper, cardboard, or other materials. Completed test patches 495 are illustrated with a solid fill, whereas incomplete test patches 495 are illustrated with a checkered fill. As print heads 410 travel across print media 499 in second print direction 482, the currently incomplete test patches 495 may be completed.

Printer 400 also includes a configuration module 440. Configuration module 440 may set the bidirectional offset value stored in configuration data store 420. The bidirectional offset value may be set based on a selection of a member of set of test patches 495. The selection may be made, for example, by a user. Consequently, the test patches 495 may be provided to a user to allow the user to make the selection. In various examples selection may be made based on graininess of the members of set of test patches 495.

Figure 5:
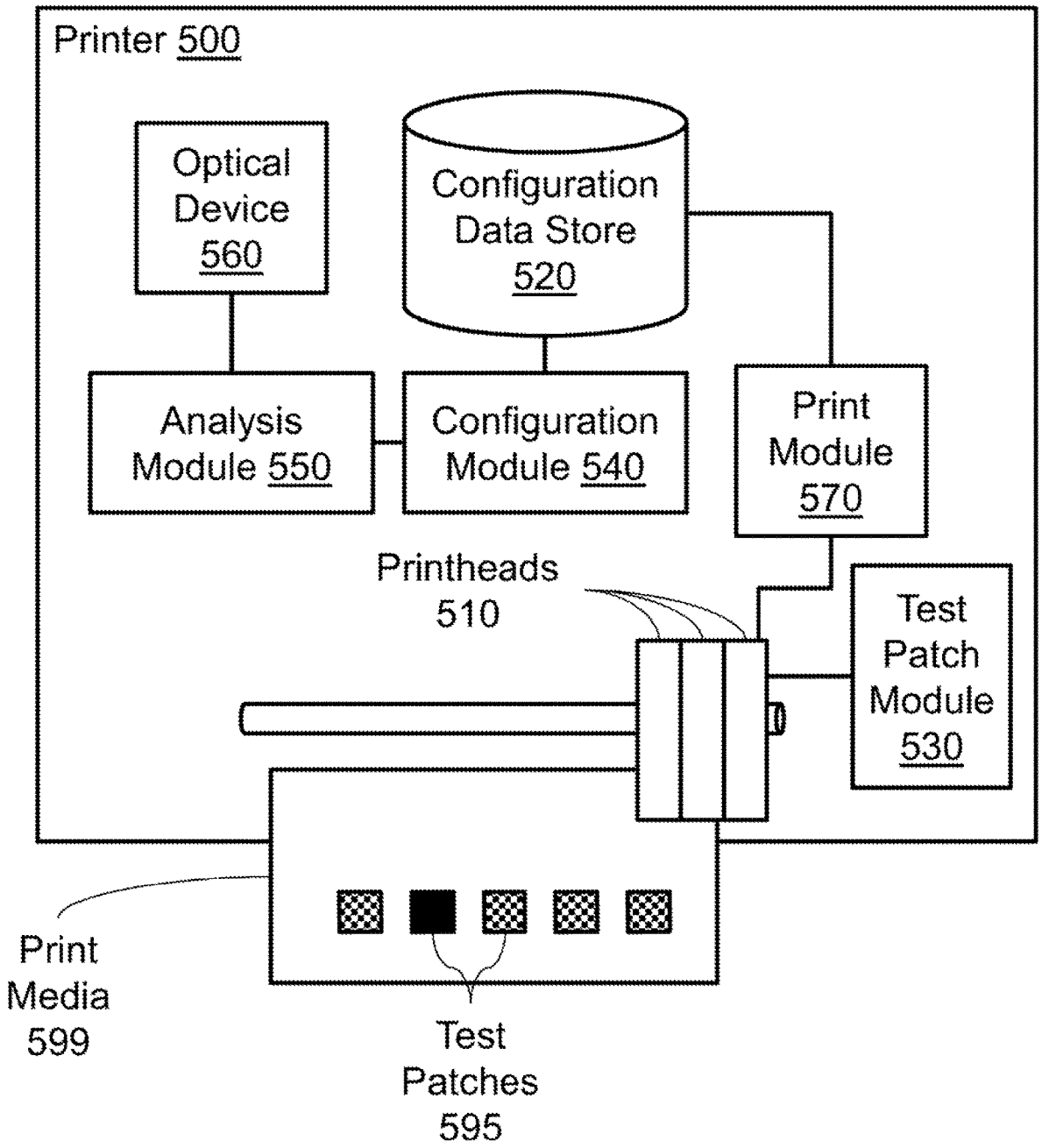
FIG. 5 illustrates another example printer associated with printer configuration.

FIG. 5 illustrates a printer 500 associated with printer calibration. Printer 500 includes several items described above with reference to printer 400. For example, printer 500 includes a set of printheads 510 that print test patches 595 onto a print media 599 in a first print direction and a second print direction, a configuration data store 520 storing a bidirectional offset value, a test patch module 530, and a configuration module 540. In this example printheads 510 have completed printing test patches 595. In this example, one of the test patches 595 has a more complete area fill than the other test patches 595 as indicated by the solid fill versus the checkered filled test patches 595. Consequently, it may be desirable to remember the offset at which the solid filled test patch 595 was printed.

Printer 500 also includes an analysis module 550. Analysis module 550 may select the member of the set of test patches used by configuration module 540 to set the bidirectional offset value in configuration data store 520. Printer 500 also includes an optical device 560 to provide the set of test patches to analysis module 550. Various optical devices 560 may be used, including, for example, a scanner, a camera, and so forth. Consequently, analysis module 550 may examine test patches 595 on print media 599 for image quality and select a test patch 595 based on the image qualities of test patches 595. Based on this selection, configuration module 540 may use an offset value associated with the selected test patch 595 to set the bidirectional offset value in configuration data store 520. Here, the selected test patch 595 may be the solid filled test patch 595.

Printer 500 also includes a print module 570. Print module 570 may complete a print job by controlling printheads 510. Printheads 510 may first be controlled by print module 570 to print a first portion of an area fill in the print job. The first portion may be printed in the first print direction. Next, printheads 510 may be controlled by print module 570 to print a second portion of the area fill in the print job. The second portion may be printed in the second print direction. Further, the second portion may be printed based on the bidirectional offset value.

Figure 6:
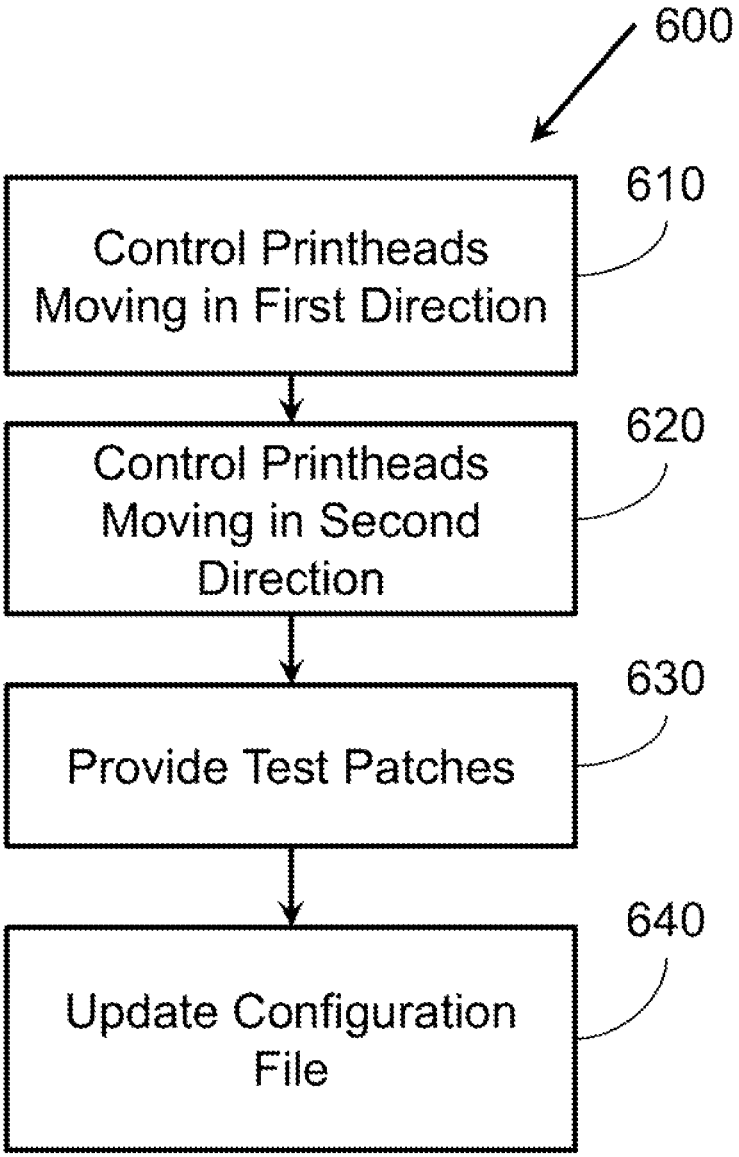
FIG. 6 illustrates another flowchart of example operations associated with printer configuration.

FIG. 6 illustrates an example method 600 associated with printer configuration. Method 600 may be embodied on a non-transitory computer-readable medium storing processor-executable instructions. The instructions, when executed by a processor, may cause the processor to perform method 600. In other examples, method 600 may exist within logic gates and/or RAM of an application specific integrated circuit (ASIC).

Method 600 includes, at 610, controlling printheads moving in a first direction to print first portions of test patches. Method 600 also includes, at 620, controlling the printheads moving in a second direction to print second portions of the test patches. The second portions of the test patches may be printed at differing offsets from respective first portions of the test patches.

Method 600 also includes providing the test patches to an image quality evaluator at 630. In some examples, the image quality evaluator may be a user. In other examples, the image quality evaluator may be a module associated with the printer (e.g., in the printer, in a computer that controls the printer). The test patches may be provided to the module via an optical input device (e.g., a scanner, a camera).

Method 600 also includes updating a configuration file at 640. Updating the configuration file may cause the printheads to print second portions of area fills in the second direction using an offset associated with a test patch selected by the image quality evaluator. Consequently, prior to updating the configuration file, a selection may be received from the image quality evaluator.

Figure 7:
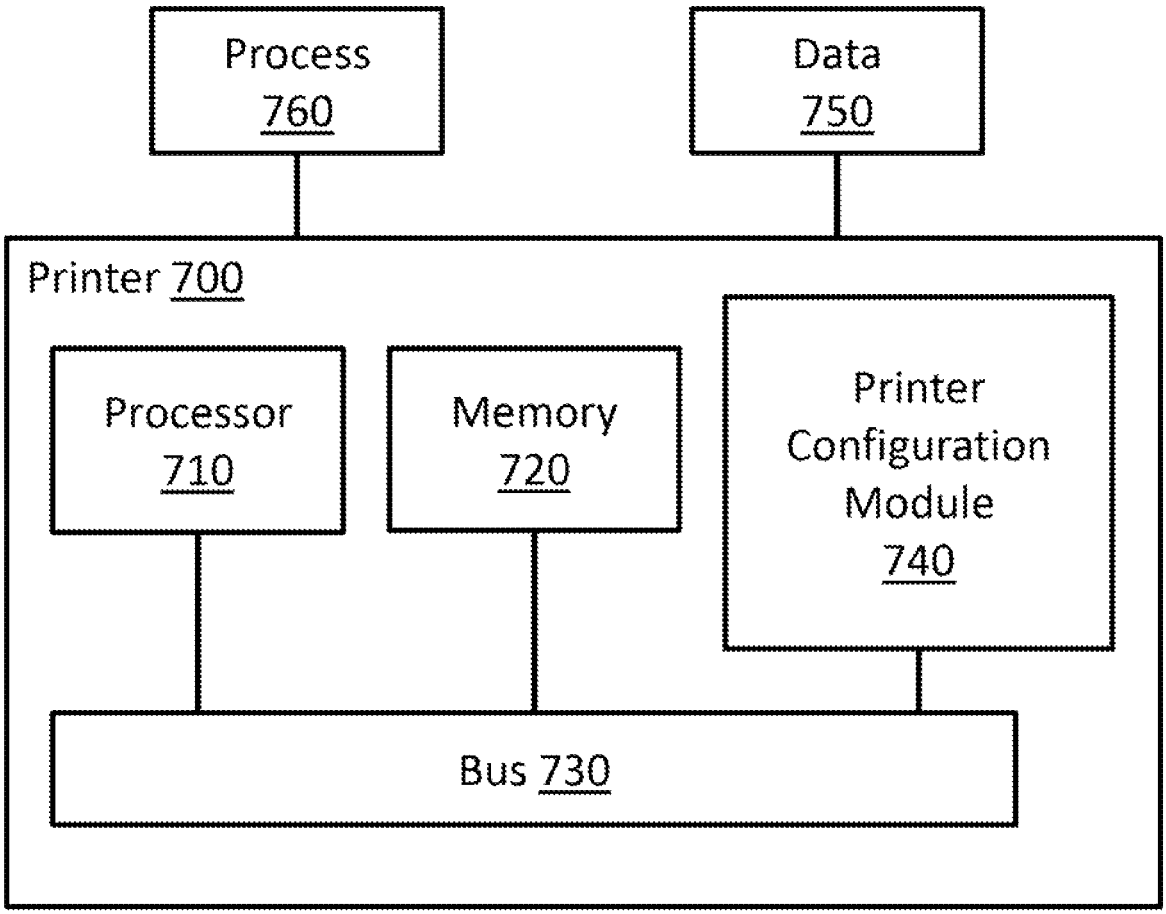
FIG. 7 illustrates an example computing device in which example systems, and methods, and equivalents, may operate.

FIG. 7 illustrates an example computing device in which example systems and methods, and equivalents, may operate. The example computing device may be a printer 700 that includes a processor 710 and a memory 720 connected by a bus 730. Printer 700 includes a printer configuration module 740. Printer configuration module 740 may perform, alone or in combination, various functions described above with reference to the example systems, methods, apparatuses, and so forth. In different examples, printer configuration module 740 may be implemented as a non-transitory computer-readable medium storing processor-executable instructions, in hardware, software, firmware, an application specific integrated circuit, and/or combinations thereof.

The instructions may also be presented to printer 700 as data 750 and/or process 760 that are temporarily stored in memory 720 and then executed by processor 710. The processor 710 may be a variety of processors including dual microprocessor and other multi-processor architectures.

Memory 720 may include non-volatile memory (e.g., read only memory) and/or volatile memory (e.g., random access memory). Memory 720 may also be, for example, a magnetic disk drive, a solid state disk drive, a floppy disk drive, a tape drive, a flash memory card, an optical disk, and so on. Thus, memory 720 may store process 760 and/or data 750. Printer 700 may also be associated with other devices including other printers, computers, peripherals, and so forth in numerous configurations (not shown).

It is appreciated that the previous description of the disclosed examples is provided to enable any person skilled in the art to make or use the present disclosure. Various modifications to these examples will be readily apparent to those skilled in the art, and the generic principles defined herein may be applied to other examples without departing from the spirit or scope of the disclosure. Thus, the present disclosure is not intended to be limited to the examples shown herein but is to be accorded the widest scope consistent with the principles and novel features disclosed herein.

What is claimed is:

1. A method, comprising:

printing, using a printer, a first portion of a first test patch and a first portion of a second test patch in a first pass of a printhead in a first print direction;

printing a second portion of the first test patch and a second portion of the second test patch in a second pass of the printhead in a second print direction, the second portion of the first test patch printed at a first alignment offset from the first portion of the first test patch and the second portion of the first test patch at a second alignment offset from the first portion of the second test patch; and configuring the printer to print in the second print direction using one of the first alignment offset and the second alignment offset based on a selection between the first test patch and the second test patch.

2. The method of claim 1, comprising providing the first test patch and the second test patch to a user, and where the selection between the first test patch and the second test patch is received from the user.

3. The method of claim 1, where configuring the printer comprises updating an alignment file that the printer reads when completing print jobs.

4. The method of claim 1, where printing the first portion of the first test patch and printing the second portion of the first test patch result in the first test patch having a first graininess, where printing the first portion of the second test patch and printing the second portion of the second test patch result in the second test patch having a second graininess, and where the selection between the first test patch and the second test patch is performed based on the first graininess and the second graininess.

5. The method of claim 4, where selecting a test patch based on graininess affects, image quality of area fills when the printer completes print jobs.

6. The method of claim 1, comprising detecting one of, an initial setup of the printer, a replacement of a component of the printer, passage of a predetermined amount of time, and an input.

7. The method of claim 1, where the second portion of the second patch is printed prior to the second portion of the first patch.

8. The method of claim 1, wherein the first portion of the second patch is printed prior to the second portion of the first patch.

9. A printer, comprising:

a set of printheads arranged to print in a first print direction and a second print direction, the second print direction opposite the first print direction;

a configuration data store to store alignment information for the set of printheads, the alignment information including a bidirectional alignment offset value;

a test patch module to control the set of printheads to print first portions of a set of test patches in a first pass of the printhead in the first print direction and to print second portions of the set of test patches in a second pass of the printhead in the second print direction, where the second portions are printed at a variety of alignment offsets from the first portions; and a configuration module to set the bidirectional alignment offset value based on a selection of a member of the set of test patches.

10. The printer of claim 9, where the selection is made based on graininess of the members of the set of test patches and where the bidirectional alignment offset value facilitates the printer creating uniform area fills in future print jobs.

11. The printer of claim 9, where the set test patches are provided to a user and where the user selects the member of the set of test patches.

12. The printer of claim 9, comprising an analysis module to select the member of the set of test patches.

13. The printer of claim 12, comprising an optical device to provide the set of test patches to the analysis module.

14. The printer of claim 9, comprising a print module to complete a print job by controlling the set of print heads to print a first portion of an area fill in the print job in the first direction and to print a second portion of the area fill in the print job in the second direction based on the bidirectional alignment offset value.

15. A non-transitory computer-readable medium storing processor-executable instructions that when executed by a processor cause the processor to:

control printheads to print first portions of test patches while the printheads are moving in a first pass in a first direction;

control the printheads to print second portions of the test patches while the printheads are moving in a second pass in a second direction, where the second portions of the test patches are printed at differing alignment offsets from respective first portions of the test patches;

provide the test patches to an image quality evaluator; and update a configuration file to cause the printheads to print second portions of area fills in the second direction using a alignment offset associated with a test patch selected by the image quality evaluator.

16. The non-transitory computer-readable medium of claim 15, where the image quality evaluator is a user.

17. The non-transitory computer-readable medium of claim 15, where the image quality evaluator is a module associated with the printer and where the test patches are provided to the module via an optical input device.

* * * * *